US007157699B2

(12) United States Patent
Ouyang et al.

(10) Patent No.: US 7,157,699 B2
(45) Date of Patent: Jan. 2, 2007

(54) MULTIPLEXED MASS SPECTROMETER

(75) Inventors: Zheng Ouyang, West Lafayette, IN (US); Robert G. Cooks, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 126 days.

(21) Appl. No.: 11/092,106

(22) Filed: Mar. 29, 2005

(65) Prior Publication Data

US 2006/0097157 A1 May 11, 2006

Related U.S. Application Data

(60) Provisional application No. 60/557,609, filed on Mar. 29, 2004.

(51) Int. Cl.
*H01J 49/26* (2006.01)

(52) U.S. Cl. ..... 250/281; 250/283; 250/292

(58) Field of Classification Search ..... None
See application file for complete search history.

(56) References Cited

U.S. PATENT DOCUMENTS

| | | | | |
|---|---|---|---|---|
| 4,536,652 | A | 8/1985 | Cooks et al. | |
| 4,791,292 | A | 12/1988 | Cooks et al. | |
| 5,026,987 | A | 6/1991 | Bier et al. | |
| 5,448,062 | A | 9/1995 | Cooks et al. | |
| 5,625,186 | A | 4/1997 | Frankevich et al. | |
| 6,580,070 | B1 * | 6/2003 | Cornish et al. | 250/287 |
| 6,664,079 | B1 * | 12/2003 | Ju et al. | 435/91.1 |
| 6,762,406 | B1 | 7/2004 | Cooks et al. | |
| 6,777,670 | B1 * | 8/2004 | Farnsworth | 250/285 |
| 6,838,666 | B1 | 1/2005 | Ouyang et al. | |
| 2002/0068366 | A1 * | 6/2002 | LaDine et al. | 436/518 |
| 2003/0089846 | A1 | 5/2003 | Cooks et al. | |
| 2003/0226963 | A1 | 12/2003 | Cooks et al. | |
| 2004/0135080 | A1 | 7/2004 | Ouyang et al. | |
| 2006/0076482 | A1 * | 4/2006 | Hobbs et al. | 250/287 |

OTHER PUBLICATIONS

S.T. Quarmby, R.A. Yost, Fundamental studies of ion injection and trapping of electrosprayed ions on a quadrupole ion trap, International Journal of Mass Spectrometry, 190/191, 1999, pp. 81-102.

Edmond de Hoffmann, Tandem Mass Spectrometry: a Primer, Journal of Mass Spectrometry, vol. 31, 1996, pp. 129-137.

M.J. Hayward, T. Kotiaho, A.K. Lister, R.G. Cooks, G.D. Austin, R. Narayan, G.T. Tsao, On-Line Monitoring of Bioreations of *Bacillus polymyxa* and *Kiebsiella oxytoca* by Membrane Introduction Tandem Mass Spectrometry with Flow Injection Analysis Sampling, Anal. Chem. 1990, 62, pp. 1798-1804.

M.J. Hayward, D.E. Riederer, T. Kotiaho, R.G. Cooks, G.D. Austin, Mei-Jywan Syu, G.T. Tsao, Bioreactor monitoring using flow injection/membrane introduction mass spectrometry with an ion trap detector, Process control and quality, Elsevier Science Publishers B.V., Amsterdam, 1, 1991, pp. 106-116.

(Continued)

*Primary Examiner*—Jack I. Berman
(74) *Attorney, Agent, or Firm*—Brinks Hofer Gilson & Lione

(57) ABSTRACT

A multiplexed mass spectrometer system includes an array of mass analyzers and a data acquisition system. Each mass analyzer is associated with one or more data channels, and the data acquisition system selectively reduces the number of data channels through combinations of particular channels to define data acquisition modes for the molecular characterization of the samples. The selective reduction in channels can be achieved, for example by software manipulation of the acquired data or by combining the detected signals.

24 Claims, 14 Drawing Sheets

OTHER PUBLICATIONS

T. Kotiaho, A.K. Lister, M.J. Hayward, R.G. Cooks, On-Line Monitoring of Chloramine Reactions By Membrane Introduction Mass Spectrometry, Talanta, vol. 38, No. 2, 1991, pp. 195-200.

W. Shui, Y. Yu, X.Xu, Z. Huang, G. Xu, P. Yang, Micro-electrospray with stainless steel emitters, Rapid Communications in Mass Spectrometry, 2003; 17: pp. 1541-1547.

Chi-Han Chiou, Gwo-Bin Lee, Hui-Ting Hsu, Pang-Wei Chen, Pao-Chi Liao, Micro devices integrated with microchannels and electrospray nozzles using PDMS casting techniques, Sensors and Actuators B 86, 2002, pp. 280-286.

Larry Licklider, Xuan-Qi Wang, Amish Desai, Yu-Chong Tai, Terry D. Lee, A Micromachined Chip-Based Electrospray Source for Mass Spectrometry, Analytical Chemistry, Vo. 72, No. 2, Jan. 15, 2000, pp. 367-375.

V. Gobry, J. van Oostrum, M. Martinelli, T.C. Rohner, F. Reymond, J.S. Rossier, H.H. Girault, Microfabricated polymer injector for direct mass spectrometry coupling, Proteomics, 2002, 2, pp. 405-412.

I.M. Lazar, R.S. Ramsey, S. Sundberg, J.M. Ramsey, Subattomole-Sensitivity Microchip Nanoelectrospray Source with Time-of-Flight Mass Spectrometry Detection, Analytical Chemistry, Vo. 71, No. 17, Sep. 1, 1999, pp. 3627-3631.

Advion http://www.advion.com/products_nanomate.php, 2004.

B. Zhang, H. Liu, B.L. Karger, F. Foret, Microfabricated Devices for Capillary Electrophoresis—Electrospray Mass Spectrometry, Analytical Chemistry, vol. 71, No. 15, Aug. 1, 1999, pp. 3258-3264.

T. Kotiaho, F.R. Lauritsen, T.K. Choudhury, R.G. Cooks, G.T. Tsao, Membrane Introduction Mass Spectrometry, Analytical Chemistry, vol. 63, No. 18, Sep. 15, 1991, pp. 875-883.

Y. Oda, K. Huang, F.R. Cross, D. Cowburn, B.T. Chait, Accurate quantitation of protein expression and site-specific phosphorylation, Proc. Natl. Acad. Sci. USA, vol. 96, Jun. 1999, pp. 6591-6596.

A.M. Tabert, A.S. Misharin, R.G. Cooks, Performance of a multiplexed chemical ionization miniature cylindrical ion trap array mass spectrometer Analyst, 2004, pp. 323-330.

A.M. Tabert, J. Griep-Raming, A.J. Guymon, R.G. Cooks, High-Throughput Miniature Cylindrical Ion Trap Array Mass Spectrometer, Analytical Chemistry, vol. 75, No. 21, Nov. 1, 2003, pp. 5656-5664.

Z. Ouyang, E.R. Badman, R.G. Cooks, Characterization of a Serial Array of Miniature Cylindrical Ion Trap Mass Analyzers, Rapid Communications in Mass Spectrometry, 13, 1999, pp. 2444-2449.

E.R. Badman, R.G. Cooks, Cylindrical Ion Trap Array with Mass Selection by Variation in Trap Dimensions, Analytical Chemistry, vol. 72, No. 20, Oct. 25, 2000, pp. 5079-5086.

E.R. Badman, R.G. Cooks, A Parallel Miniature Cylindrical Ion Trap Array, Analytical Chemistry, vol. 72, No. 14, Jul. 15, 2000, pp. 3291-3297.

C.K. Van Pelt, T.N. Corso, G.A. Schultz, S. Lowes, J. Henion, A Four-Column Parallel Chromatography System for Isocratic or Gradient LC/MS Analyses, Analytical Chemistry, vol. 73, No. 3, Feb. 1, 2001, pp. 582-588.

K.L. Busch; S.A. McLuckey; G.K. Glish, Mass Spectrometry/Mass Spectrometry: Techniques and Applications of Tandem Mass Spectrometry, VCH Publishers, Inc.: New York, 1988, p. 173.

C. Beecher, Metabolomics: A new "Omics" Technology, American Genomic/Proteomic Technology, 2002, 2(3), pp. 40-43.

Z. Ouyang, G. Wu, Y. Song, H. Li, W.R. Plass, R.G. Cooks, Rectilinear Ion Trap: Concepts, Calculations, and Analytical Performance of a New Mass Analyzer, Analytical Chemistry, vol. 76, No. 16, Aug. 15, 2004, pp. 4595-4605.

* cited by examiner

MULTIPLEXED MASS SPECTROMETER

RELATED APPLICATION

This application claims the benefit of U.S. Provisional Application No. 60/557,609, filed Mar. 29, 2004, the entire contents of which are incorporated herein by reference.

BACKGROUND

This invention relates generally to mass spectrometers and methods of their operation.

Mass spectrometers of various types have been used to identify molecules and to determine their molecular structure by mass analysis. The molecules are ionized and then introduced into the mass spectrometer for mass analysis. Typically, the mass analysis is performed using a "single channel". That is, a sample introduction system collects a single sample and introduces this sample to a single ion source where the sample is ionized. The ion source is connected to a single mass analyzer, or perhaps to a multiple-stage (serial) mass analyzer, which in turn is followed by a single detector and a one channel data acquisition system. Even though a robotic device may be used to collect the samples from, for example, multiple wells in a microtiter plate, the samples have to be analyzed serially by single channel systems, and, therefore, the throughput capabilities of these systems are quite limited.

Recently, a four-column liquid chromatography system has been implemented for the analyses of pharmacokinetic assays and for similar quantitative applications. However, in this system, the multiple liquid chromatography channels are coupled to a single channel mass spectrometer. Hence, again, the throughput of this system is limited by the single channel associated with the mass spectrometer.

Accordingly, there is a need for mass spectrometer systems with significantly higher throughput than conventional single channel systems.

SUMMARY

The present invention is directed to a multiplexed mass spectrometer system and methods of its operations for performing multi-channel analysis on multiple samples handled in a parallel fashion. The system can accommodate any type of mass analyzer or any combination of mass analyzers. The number of the channels of analysis can be selected virtually, that is, through software implemented in the system.

In an embodiment of the invention, a multiplexed mass spectrometer system includes an array of ion traps and a data acquisition system. Each ion trap is associated with one or more data channels, and the data acquisition system selectively reduces the number of data channels through combinations of particular channels to define data acquisition modes for the characterization of the samples. The selective reduction in channels can be achieved, for example by software manipulation of the acquired data or by combining the detected signals.

In some implementations, the ion traps are rectilinear ion traps. With such traps, two-direction radial ejection can be used to implement two data acquisition modes simultaneously. Alternatively, axial ejection, with or without x,y radial ejection, can be used to implement multiple data acquisition modes.

Further features and advantages will become readily apparent from the following description, and from the claims.

DETAILED DESCRIPTION

Figure 1:
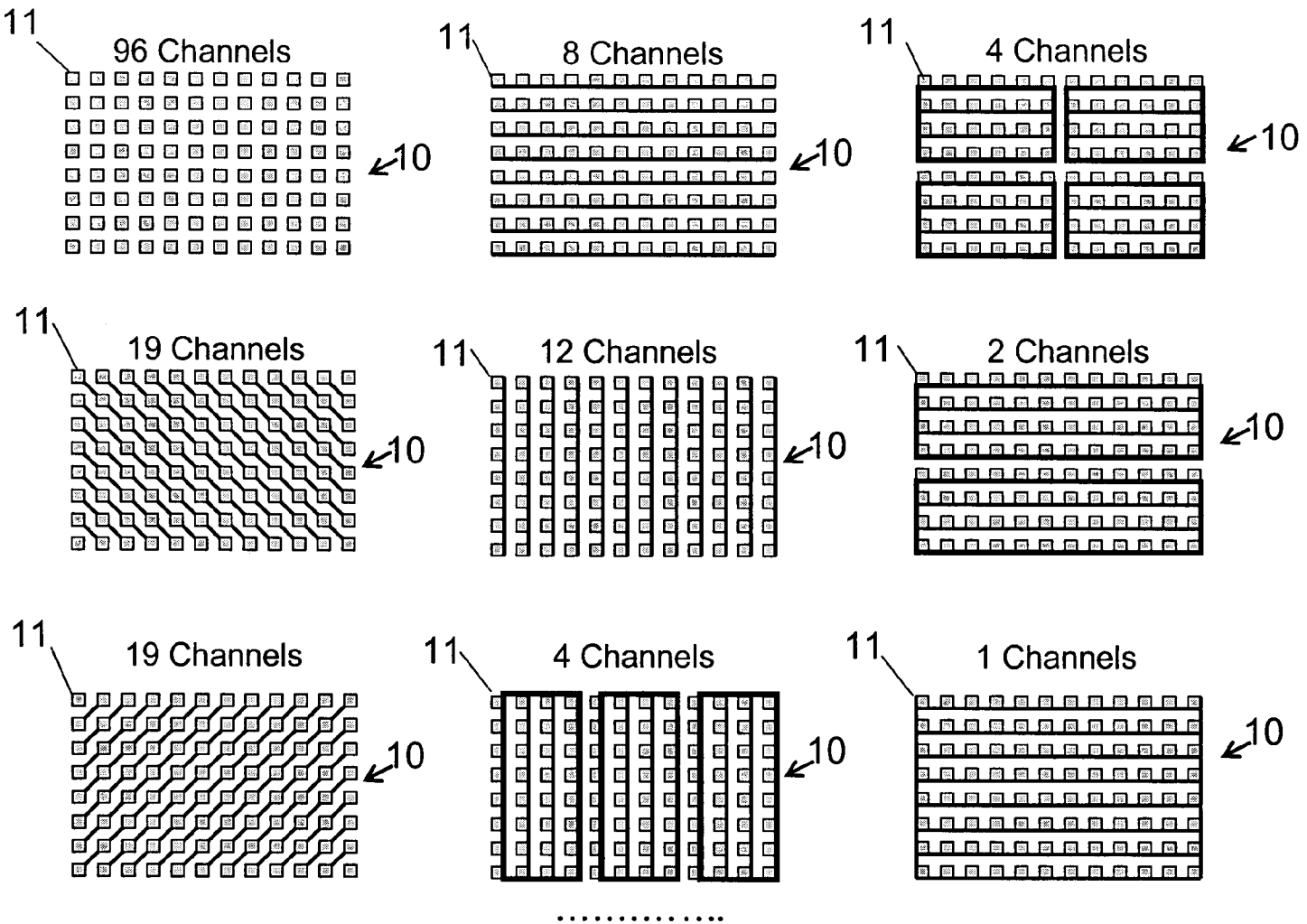
FIG. 1 shows various detection or data acquisition modes (DAQ) for a 96 sample mass analysis in accordance with the invention.

In accordance with the invention, signals from an array of mass analyzers associated with an array of samples are analyzed in a parallel manner. The signals are grouped into one or more groups associated with detection or data acquisition (DAQ) modes. For example, for an array 10 of 96 samples 11 illustrated in FIG. 1, the DAQ modes can be selected for 1 channel of 96 samples; 2 channels, each with 12 column by 4 row subarray of samples; 4 channels, each with 6 by 4 subarray of samples; 4 channels, each with 3 by 8 subarray of samples; 12 channels, each with a column of 8 samples; 8 channels, each with a row of 12 samples; 19 channels, each grouped diagonally from the bottom left side to the upper right side of the array of samples; 19 channels, each grouped diagonally from the bottom right side to the upper left side of the array of samples; and 96 channels, each associated with an individual sample.

The selection of the DAQ modes is dependent on the purpose of the experiment. For instance, when large numbers of samples are screened to find targeted product compounds, as in combinatorial chemistry, one detector can be used to collect the signals from all 96 mass analyzers to provide one spectrum, which allow identification of the existence of the target compound in any of the 96 samples. Subsequent experiments can then be used to locate the one (or more) active fractions. In cases in which "hits" are rare, this represents significant reduction in hardware for data acquisition and time for subsequent data processing.

Figure 2:
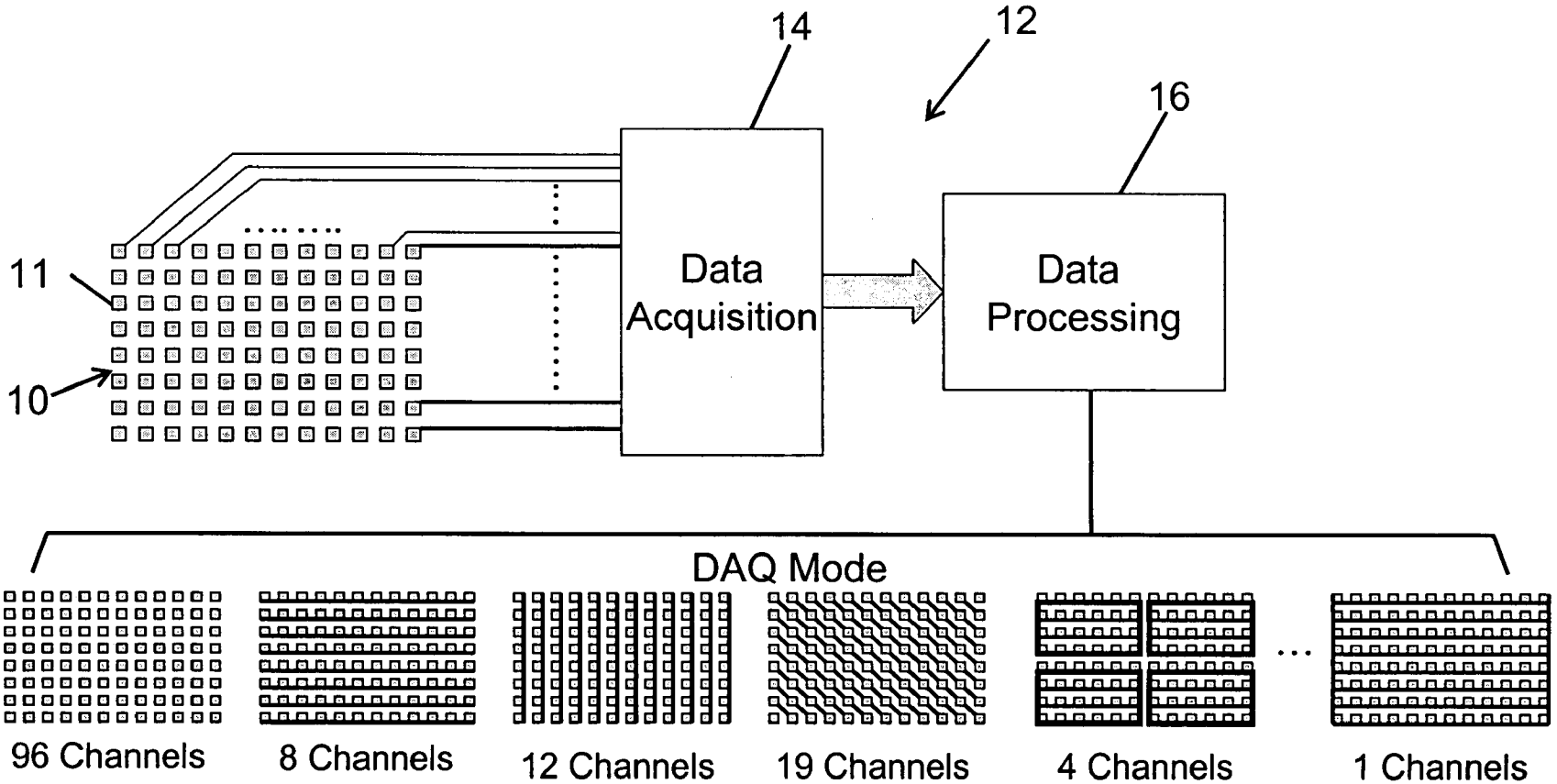
FIG. 2 shows post-acquisition data reduction of the 96 samples using software in accordance with the invention.
Figure 3:
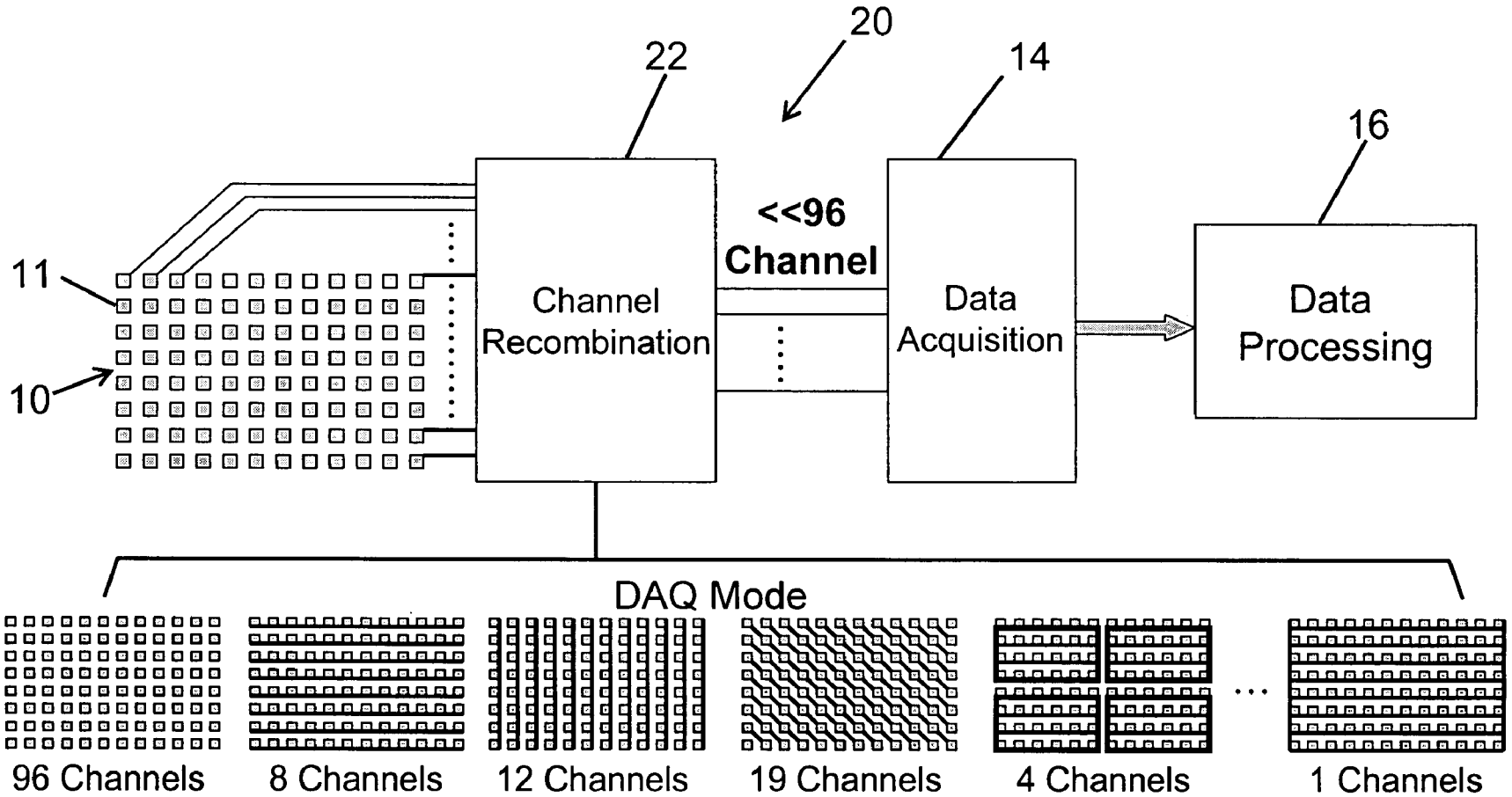
FIG. 3 shows data reduction of the 96 samples by combining the detector outputs in accordance with the invention.

In accordance with the invention, the signals acquired from 96 samples can be reduced by three different schemes. For example, as shown in FIG. 2, a multiplexed mass spectrometer system 12 includes a data acquisition process 14 and data processing 16. The data acquisition process 14 acquires and records signals from all the mass analyzers associated with the respective samples 11 and transmits this information to data processing 16, which is implemented with software that reduces the data in accordance with the desired DAQ mode.

In another implementation, a multiplexed mass spectrometer system 20 includes a channel recombination block 22 in addition to the data acquisition process 14 and data processing 16. The system 20 reduces the data from the 96 mass analyzers 10 by combining or otherwise manipulating the output from the various analyzers. Specifically, the output of each mass analyzer for each channel can be connected together in groups. This allows the number of the channels of signal detection and data transfer to be significantly reduced. The combination of the outputs can be done using hardware connections or can be made in real time by using a controllable electric switch, which allow changes in the detection mode between each DAQ cycle. The change of the modes can also be performed by changing the channels into which particular samples are introduced. For mass analyzers like rectilinear ion traps (RIT), which allow radial ejection of ions in two directions simultaneously, two detection modes (which can be different or identical and redundant) can be performed at the same time. The ions can be also be ejected axially. This provides an alternative third mode to be performed that is not simultaneous with the first two.

In yet another implementation, ions within each group or channel can be transferred into a single mass analyzer. This scheme reduces the number of the mass analyzers and associated hardware. For some types of the mass analyzers, such as RITs, the ions can be transferred between mass analyzers to allow the recombination of the channels.

In particular implementations, all three schemes described above can be implemented in a single instrument. The comparison between each group of samples can be performed by data comparison between the channels.

In addition to RITs, other types of analyzers may be implemented in the above-described schemes, such as unstructured elements which pass information to a single detector in a one-to-one isotropic relationship. A particular advantage of an RIT is that it splits the signal in two separate directions like a semi-reflecting mirror, thus providing similar advantages of conventional interferometers. The resulting signals for a set of RIT elements can be compared, such that non-zero differences indicate non-identity in the set of RIT elements. The location of the non-identical element can be found by an orthogonal operation. This can be implemented in hardware or in software.

Another feature of RITs is that the signal can be ejected from an RIT axially or radially, as selected in software. This can be used as an alternative to the detector based (up/down) method of selecting individual channels.

An RIT can be implemented as a cubic trap in which all three directions can be made equivalent by switching the positions on which the radio frequency trapping fields are applied. This type of trap allows ejection along any Cartesian coordinate without using the Sciex fringe field idea.

These cubic traps can be operated in two modes: 1) ions emerge in one direction along a single Cartesian coordinate; 2) ions emerge equally or unequally in two directions. Either hardware switching or voltage changes instructed by software can be used to select between these two modes.

In the single direction mode, an active element (i.e., a component providing a signal at a particular m/z value or at a set of m/z values) in a set of inactive elements can be detected by measuring spectra on each row and on each column in an array of RITs and then comparing the data. Thus, as a fast scan for positives, this procedure is quick and very useful.

In the dual direction equal quantity mode, for each of the two Cartesian directions used for detection there are two types of detector strips: in row or in column. For each group of row (or column) strips, there are boundary detector elements and internal detector elements. The boundary elements measure signals only for the first and last rows (or columns) of RITs in the array, while the internal elements measure combination signals from two rows (or columns) or RITs which can be numerically resolved into signals for individual row (or column) elements. Therefore, n+1 measurements are made to cover n rows (or columns) or RIT mass analysis elements.

In the dual direction unequal quantity mode, the introduction of another variable is achieved readily through adjusting the ion trap voltage. This provides one extra measurement to completely specify the individual elements that are poorly specified in the dual direction equal quantity mode.

Subtraction is typically used as the mathematical signal processing operation to locate signals in samples. Other operations, however, can be used as well. For example, a signal can be quantified by comparing it to the signals from a standard. This standard can be introduced into a reference row of samples that has a gradation in concentration. When comparing the sample signal to the reference row, the average standard concentration can be employed. Then by comparing with each column containing one reference RIT element, a more accurate sample concentration can be obtained by measuring against a more appropriate reference concentration. Thus, for example, if the first row of RITs is a set of eight references, then comparing any other row with the average signal of the first row, it can be determined whether a sample exists in that row. Then by comparison with each reference elements, the accurate sample concentration can be estimated.

Figure 4:
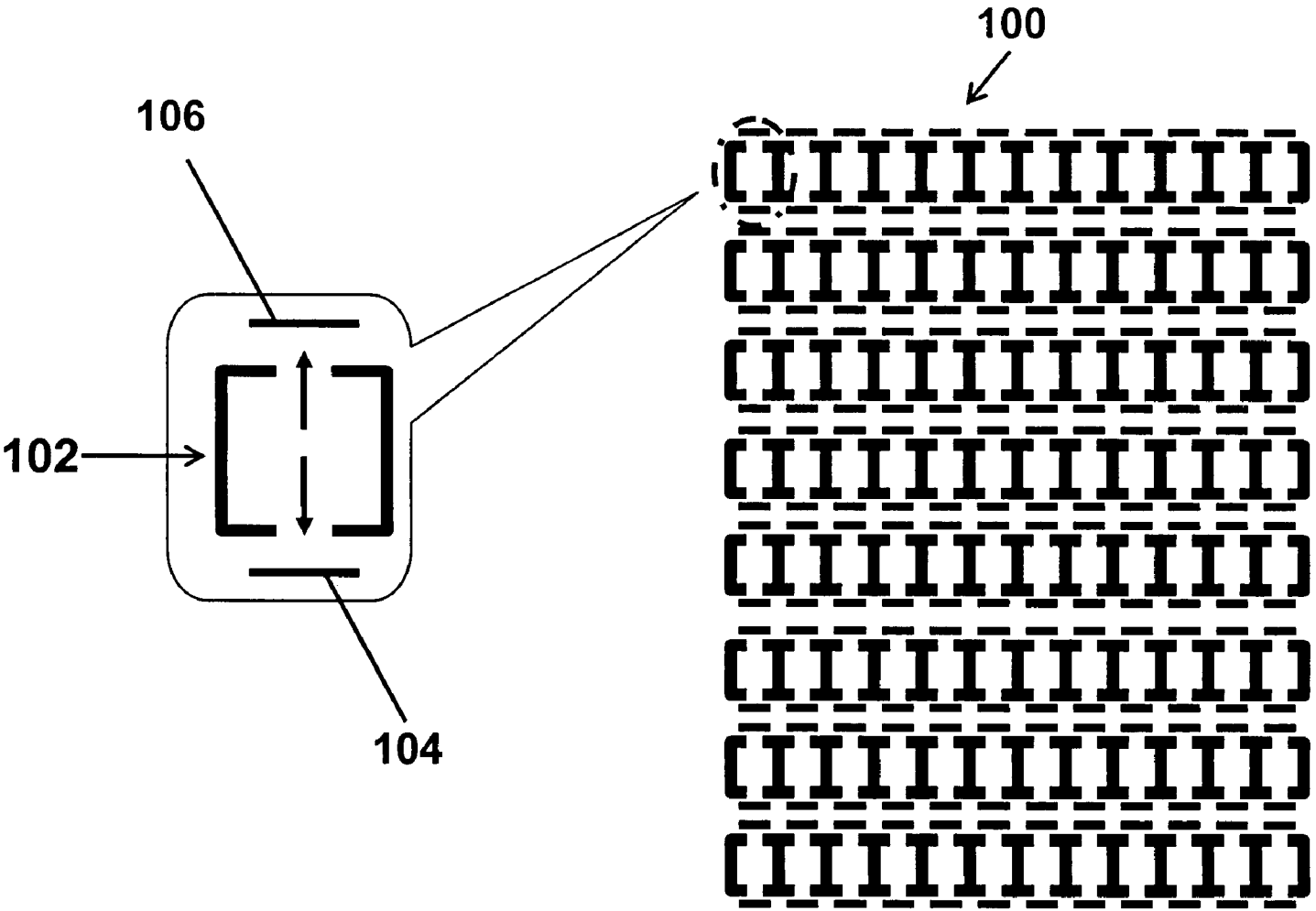
FIG. 4 shows an array of rectilinear ion trap (RIT) elements with two detectors.

Any of the systems described above may include an array 100 of RIT elements 102 shown in FIG. 4. Each RIT element 102 is associated with two detectors 104, 106 which can detect ions ejected towards the top and bottom of the RIT element 102 simultaneously.

Figures 5A, 5B:
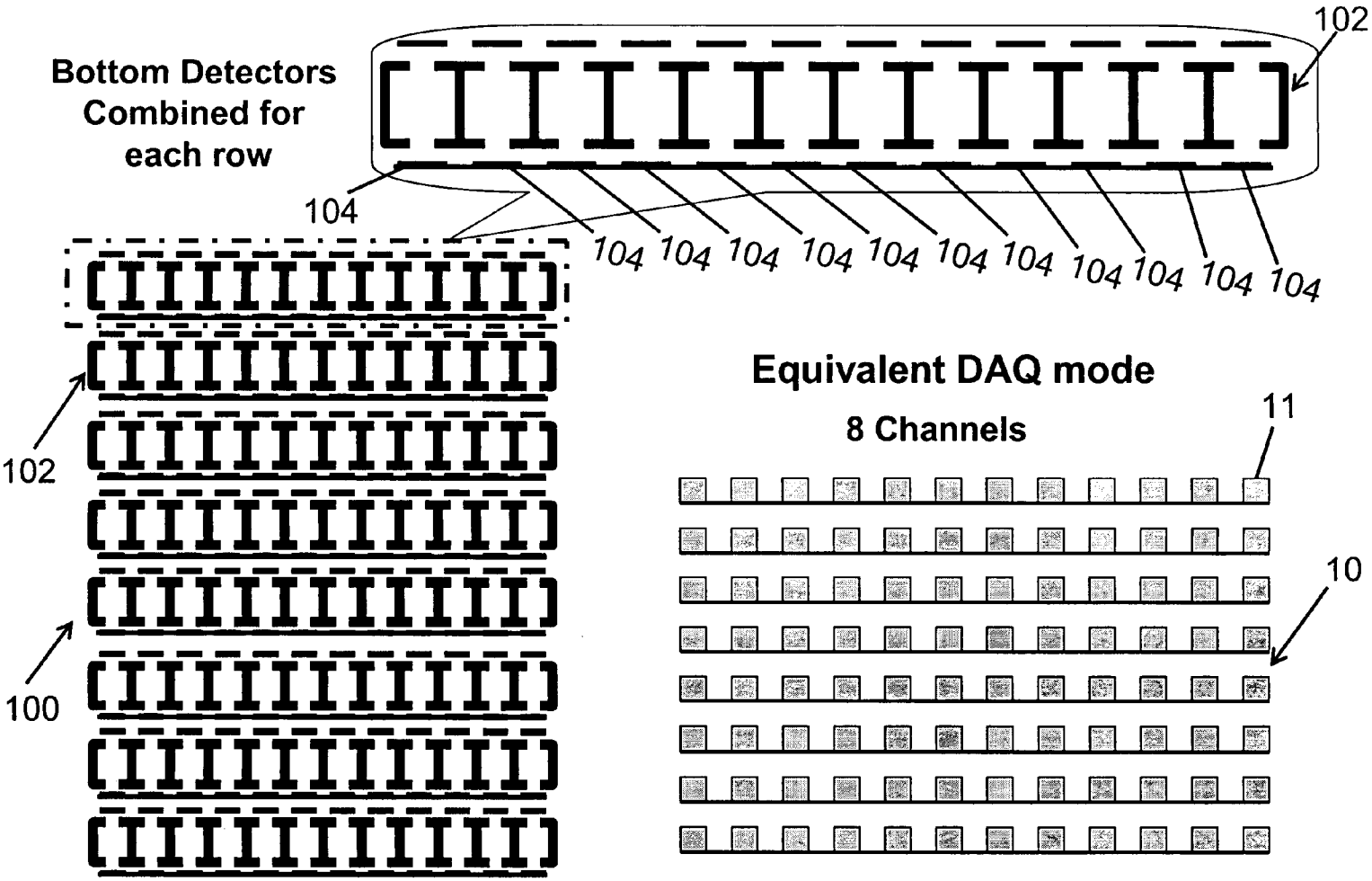
FIG. 5 shows an 8-channel DAQ mode for the array of 96 RIT elements.
Figures 6A, 6B:
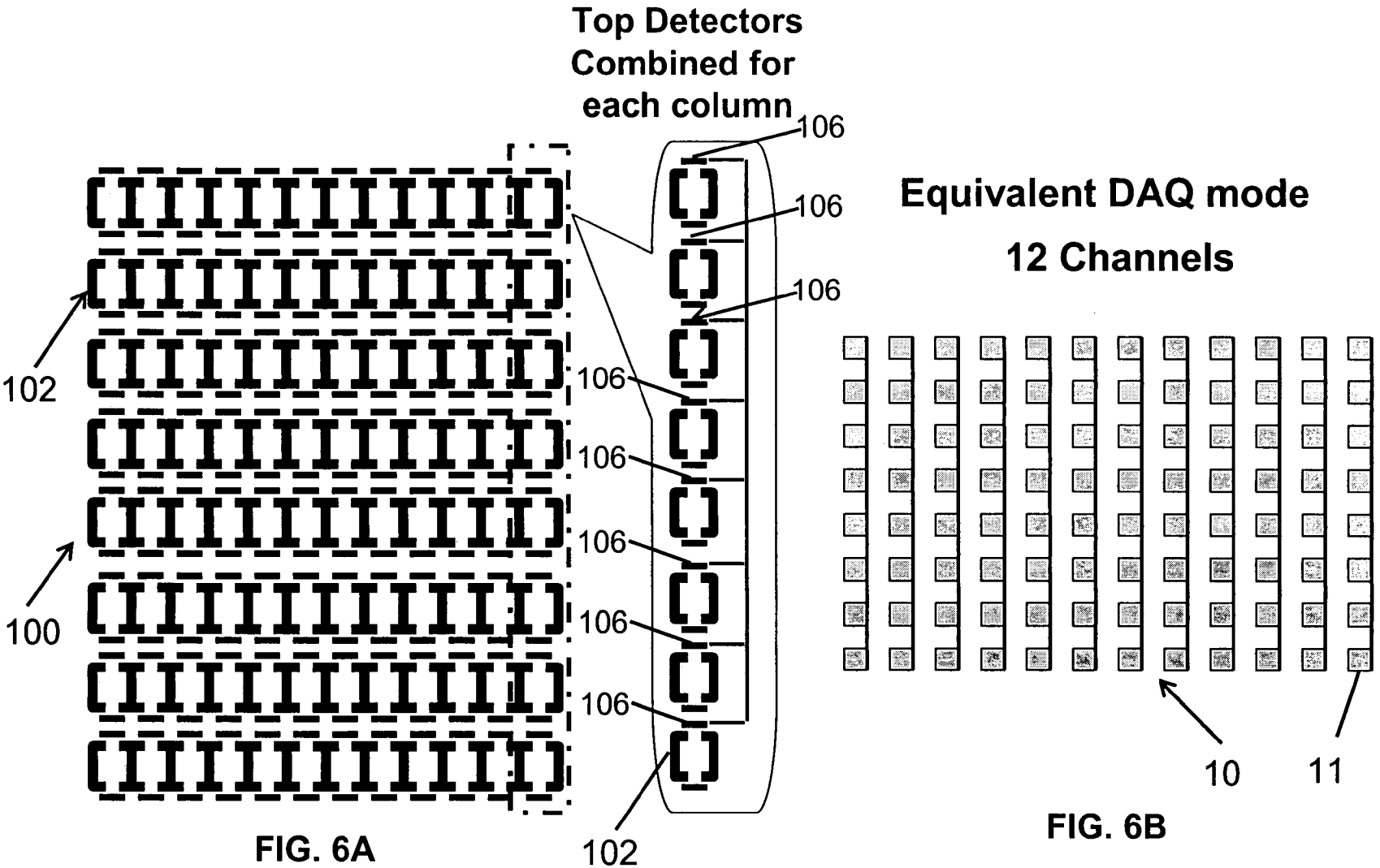
FIG. 6 shows a 12-channel DAQ mode for the array of 96 RIT elements.

Different data acquisition modes can be applied for the array 100 and two data acquisition modes can be applied simultaneously because ions from an RIT element 102 can be detected by two detectors at the same time. Thus, the array 100 can be used in various DAQ modes. For example, as shown in FIGS. 5A and 5B, the array 100 can be used in a DAQ mode with 8 channels. Specifically, the signals detected by the bottom detectors 104 associated with each row of RIT elements 102 are combined by connecting the bottom detectors for all the RITs in a row or by electrically connecting individual bottom detectors in a row with the controllable electric switch described previously. When the signals detected by the top detectors 106 in each column of RIT elements 102 array are combined, as shown in FIGS. 6A and 6B, a DAQ mode with 12 channels can be implemented.

Figure 7:
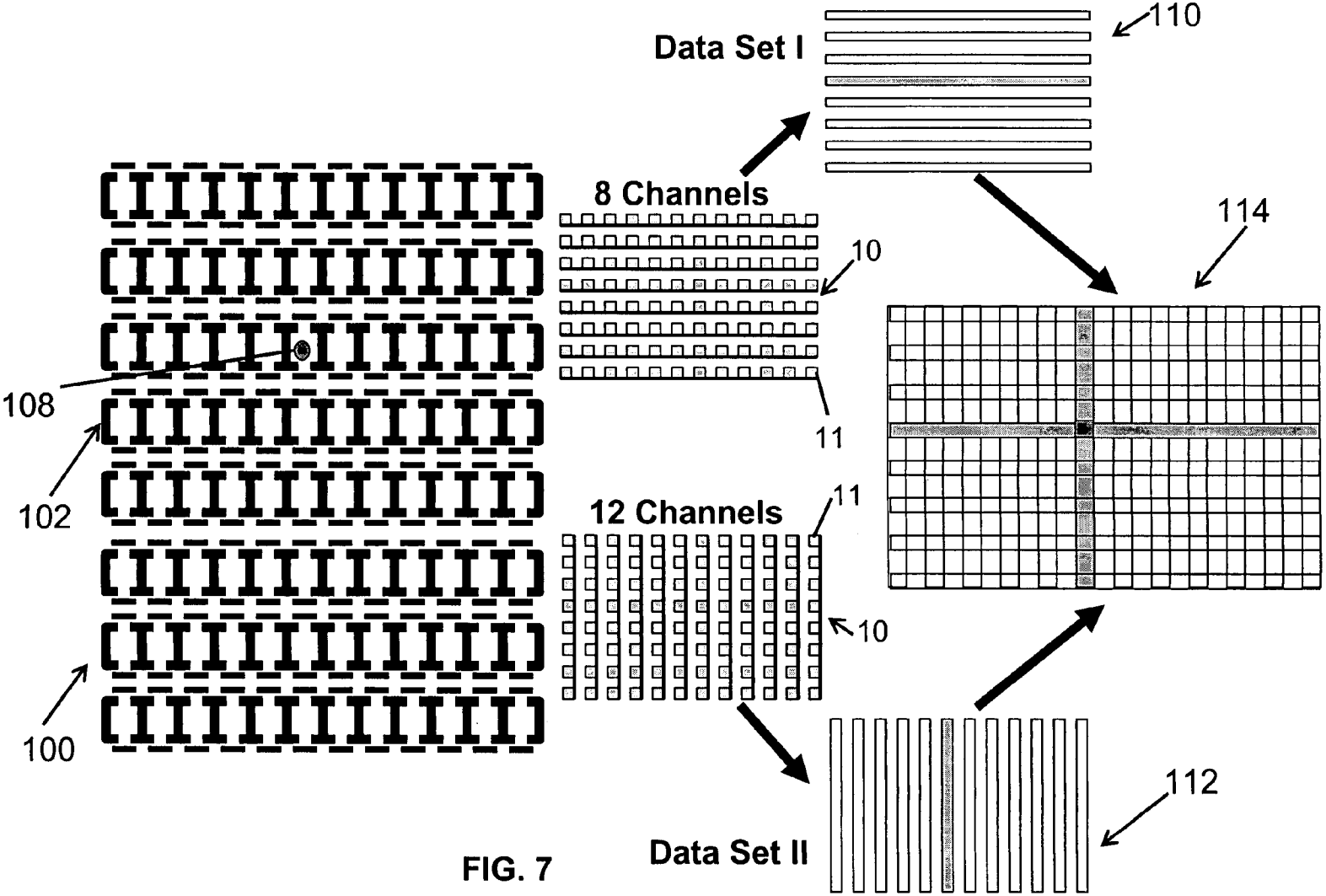
FIG. 7 shows fast screening using two DAQ modes to locate a sample of interest in accordance with the invention.

If only one of the 96 samples, for example, a sample 108 shown in FIG. 7, contains the targeted compounds, it can be analyzed by one of the RIT elements 102 in the array in a fast screening process by applying the 8-channel and 12-channel DAQ modes simultaneously. As such, two sets of data 110, 112 are acquired and the channel of the sample containing the targeted compounds can be rapidly located by finding the intersection of these two data sets 114.

RIT elements capable of ejecting ions in up to six directions (or up to five leaving one direction for one for ion injection) are also considered in the present invention. With such RIT elements, DAQ modes can be applied by five sets of detectors, among which up to two can be applied simultaneously. With a cubic ion trap, these directions can be made up of three equivalent pairs. (See, e.g., U.S. Pat. No. 6,838,666, the entire contents of which are incorporated herein by reference.) Using 1 set of detectors, an almost unlimited number of data acquisition modes can be applied in series through the recombination of the detectors in the array using a controllable electric switch.

Figure 11:
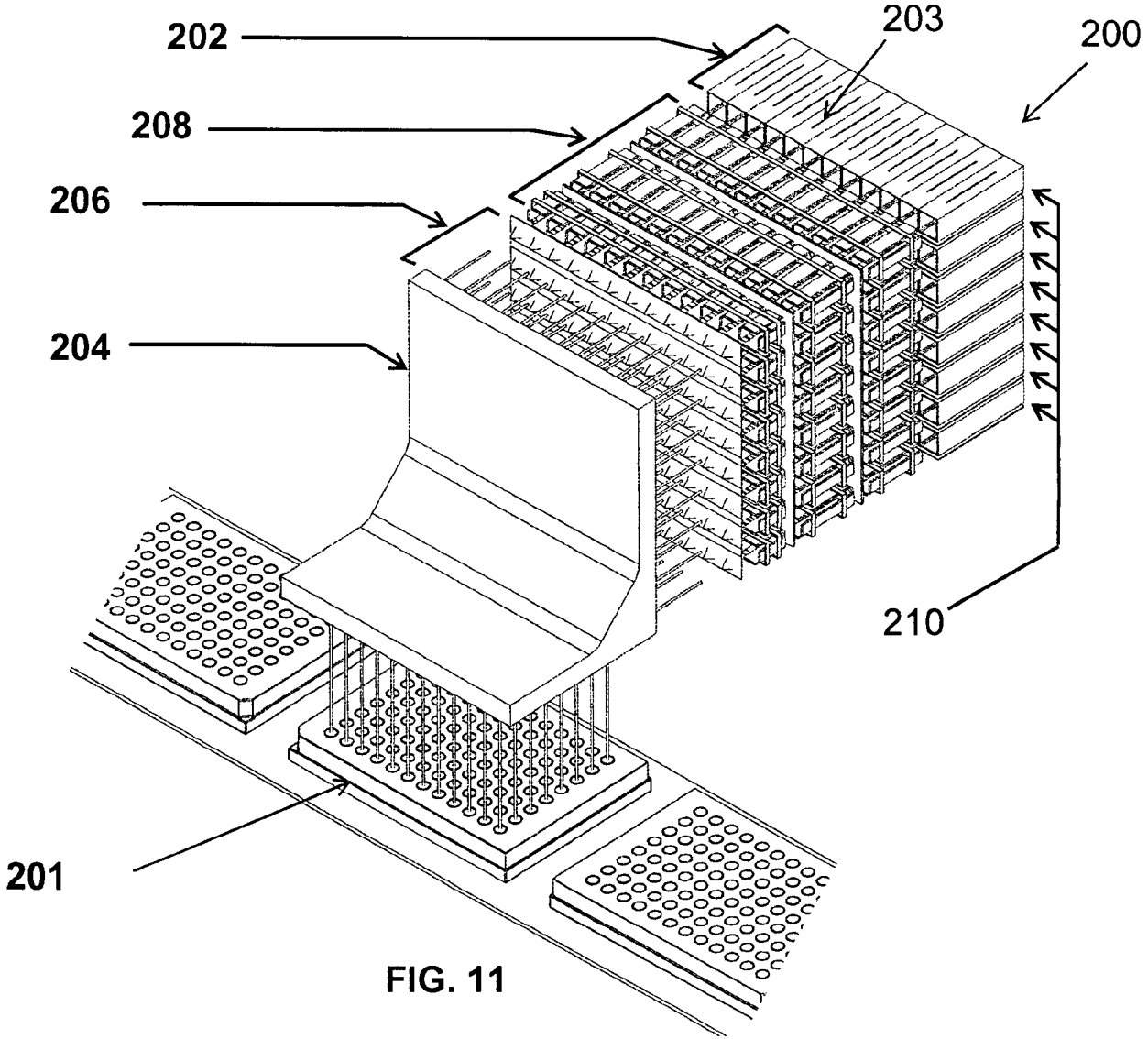
FIG. 11 shows a schematic perspective view of a system with an array of RIT mass analyzers together with a microfluidics sample handling and ion transport systems in accordance with the invention.

In another implementation, a multiplexed mass spectrometer system 200 shown in FIG. 11 acquires information on, for example, an array of 96 wells on a micro-titer plate 201, and on the metabolic products and their fluxes. The system 200 has a unit resolution, for example, of about 1500 Da/charge, and can be used to identify and quantify specific compounds in the solution (with a capacity of approximately 100 nL). The system 200 is modular; that is, the system 200 can use electrospray ionization, corona discharge ionization associated with atmospheric pressure ionization (to analyze, for example, the aqueous growth medium), or reduced pressure corona discharge ionization (to analyze, for example, the volatile components in the head-space). The modularity also enables using either membrane sampling or capillary electrophoresis in conjunction with any of these ionization methods. For example, ion trap mass spectrometers can be used in combination with a silicone polymer membrane introduction system to sample fermentators for their more volatile components in the extra-cellular fluid to be quantitively examined as a function of time as well. Hence, such a configuration can be extended to cover 96 samples or more such as that for the system 200. Although the system 200 can be used in the study of microorganism metabolites, an electrospray version can be used for proteomics analysis of the same samples, which enables cross-correlation of the data with proteomics to more fully integrate data.

With the system 200, the products of the suite of microorganisms (knock-out gene variants on a single organism)—as well as other sets of cell cultures using other variables—can be examined as a function of time for their distinctive volatile substances. These are likely to reflect the metabolic activity of the cell. In addition, metabolic fluxes is examined by following in real time the shift in mass of the metabolites associated with C-13 incorporation from labeled glucose and other precursors.

Figure 8:
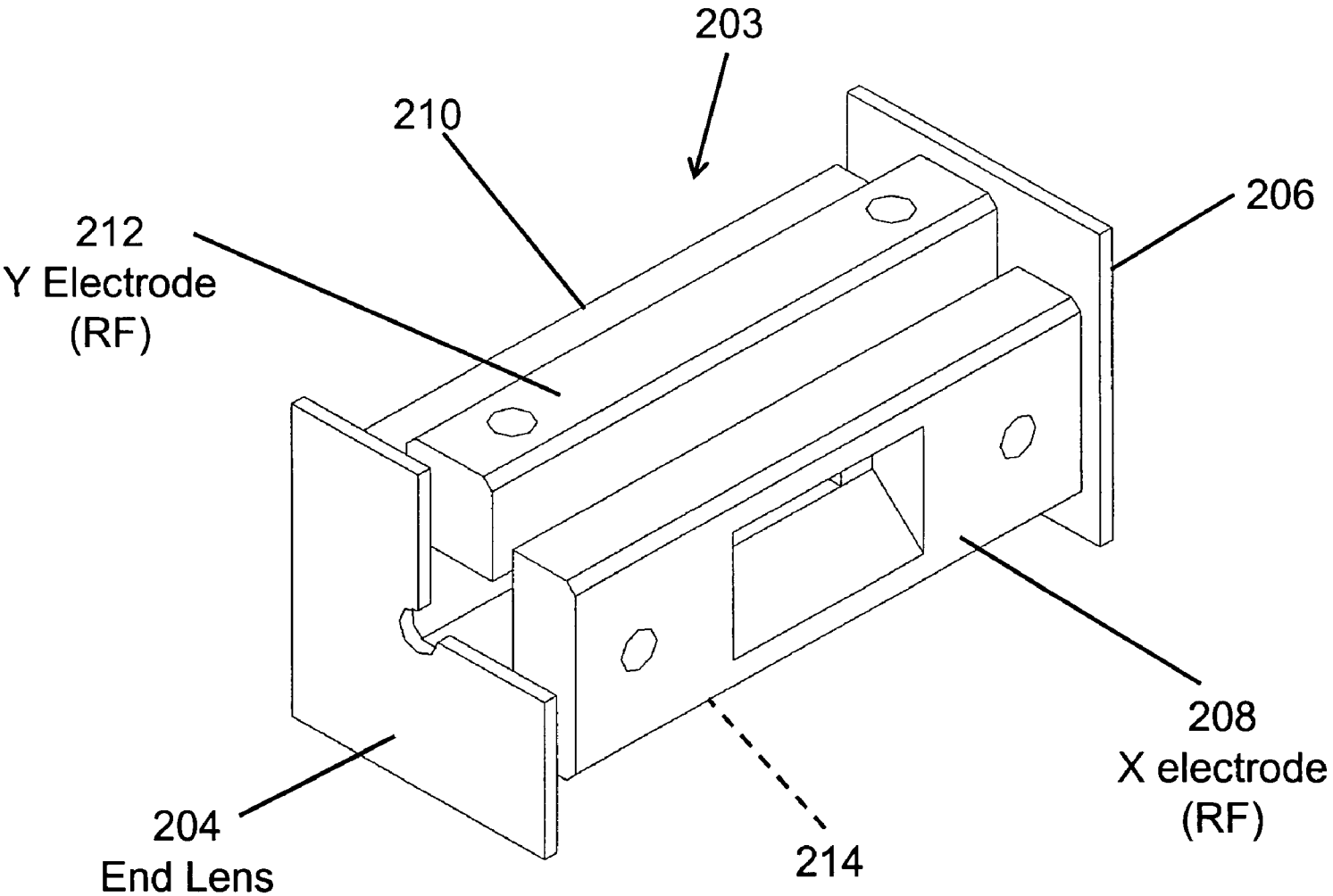
FIG. 8 is an orthogonal view of a rectilinear ion trap.

Referring also to FIG. 8, the system 200 includes an array 202 of rectilinear ion trap (RIT) mass analyzers 203. The RIT analyzer 202 is a linear quadrupole-field ion trap with a pair of DC electrodes 204, 206, a pair of x RF electrodes 208, 210, and a pair of y RF electrodes 212, 214, as show in FIG. 8. The electrodes 204, 206, 208, 210, 212, 214 are flat to facilitate machining of a small instrument.

Figure 9A:
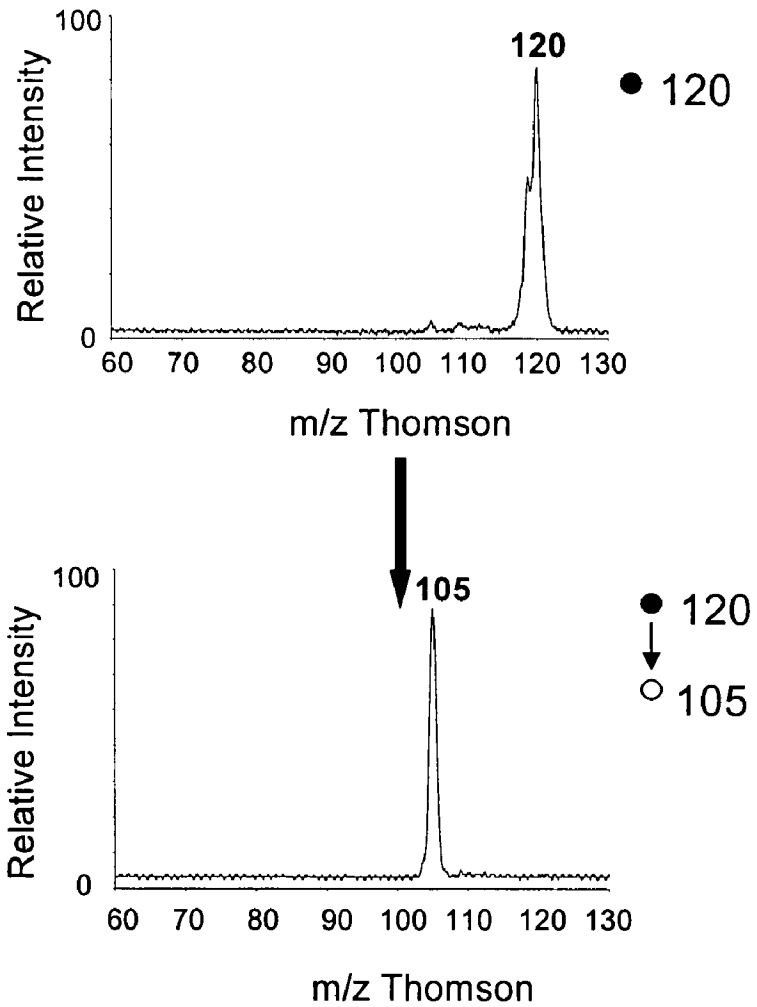
FIG. 9A shows the MS/MS data for acetophenone in the rectilinear trap of FIG. 8.
Figure 9B:
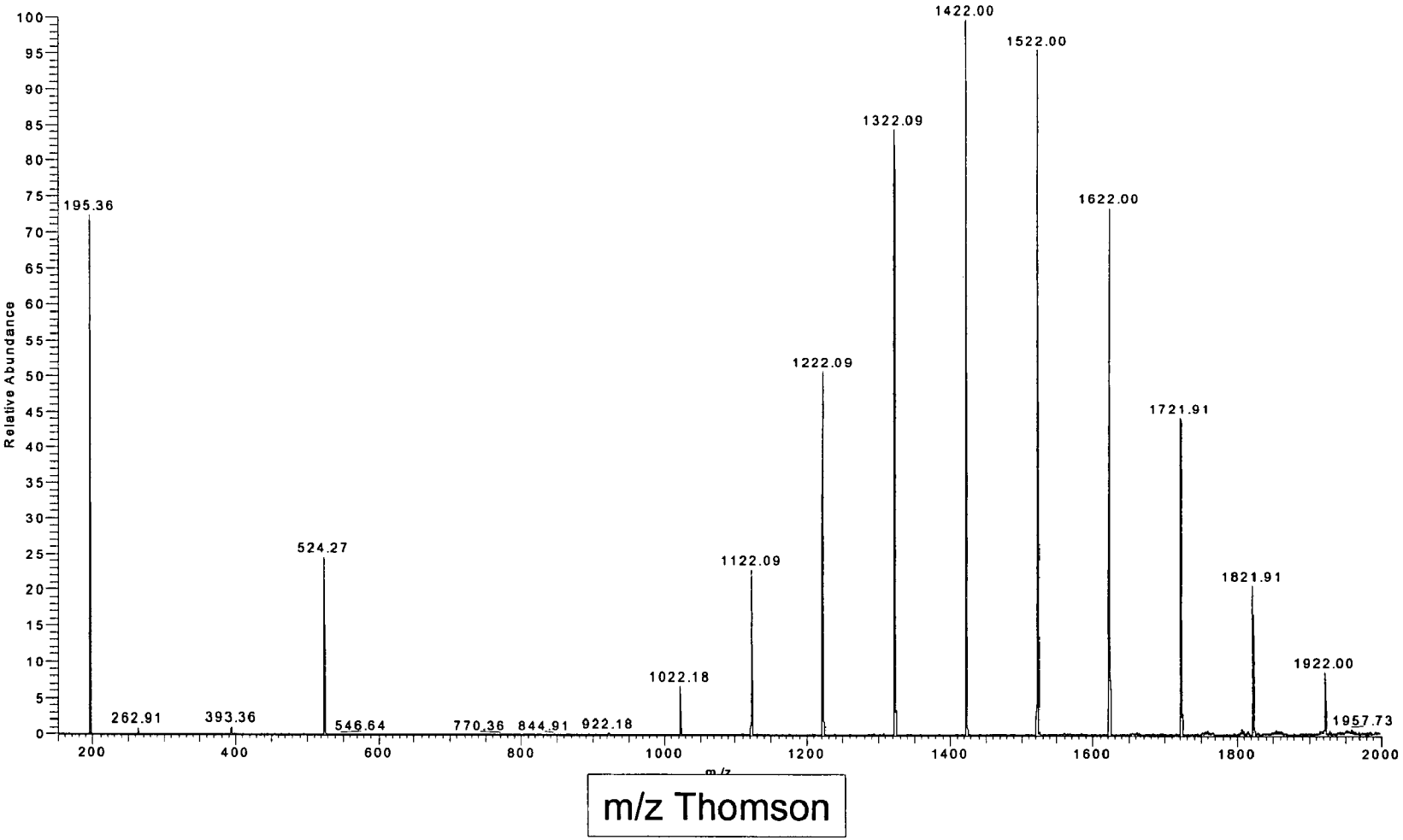
FIG. 9B is the spectrum of mixture of caffeine, MRFA and Ultramark showing ions to m/z 2000 for the rectilinear trap of FIG. 8.

The RIT analyzer 202 has a higher ion trapping capacity than a conventional "three-dimensional" quadrupole ion trap (QIT) or a cylindrical ion trap (CIT). The RIT analyzer 202 offers improved resolution, mass accuracy, sensitivity, and dynamic range. RIT's also enjoy about 95% ion injection efficiency for externally injected ions, compared to less than 5% with QIT's and CIT's, in which the alternating RF fields allow trapping over a smaller range of RF phase angles. The RIT analyzer 202 can have up to 20-fold improvement in sensitivity over CIT's, and can have unit mass resolution to m/z 2000, when operated at a standard RF frequency of about 1.1 MHz. The RIT analyzer 202 has tandem mass spectrometry capabilities which facilitate mixture analysis. The mass range and MS/MS capabilities of the RIT analyzer 202 are illustrated in FIG. 9.

Figure 10:
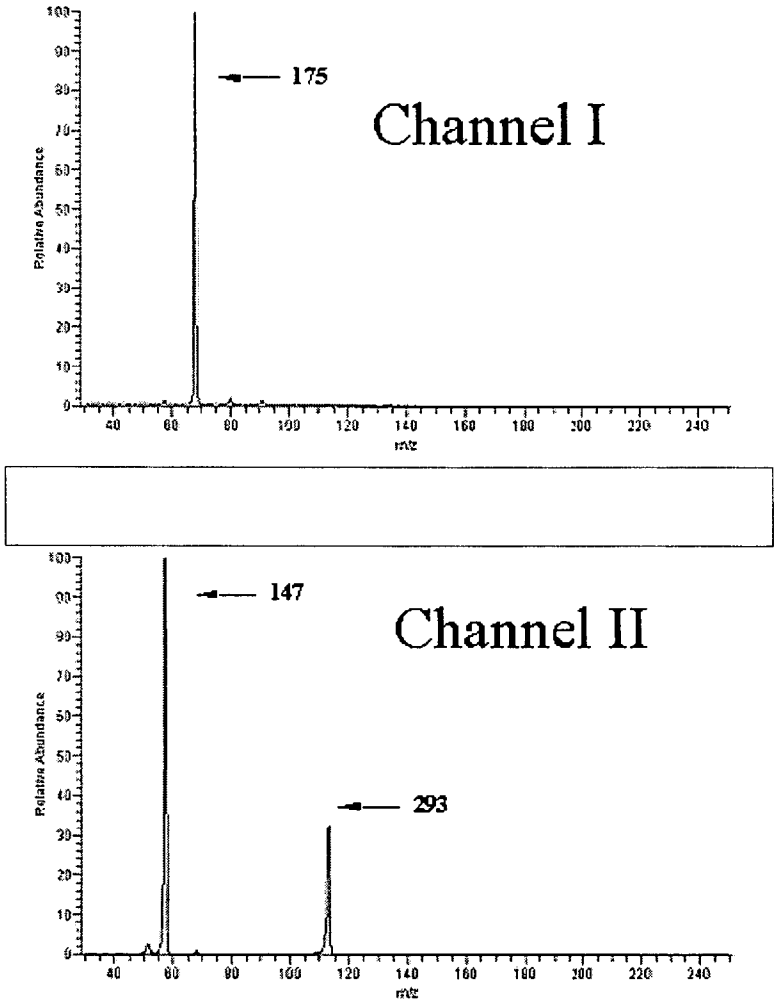
FIG. 10 shows an output of a multiplexed cylindrical ion trap mass spectrometer used to simultaneously analyze arginine (top, $M+H^+$) and glutamine (bottom, $M+H^+$ and $2M+H^+$) using electrospray ionization.

FIG. 10 shows data for an experiment using a mass spectrometer capable of two-channel analysis, in which arginine was sprayed in one channel while glutamine was sprayed in an adjacent channel. The resulting mass spectra show very little evidence of cross talk. In another experiment, four parallel channels were built to allow simultaneous high-throughput analysis of multiple samples. Spectra of four separate samples, using both electron or chemical ionization, were recorded simultaneously in real time. A CIT analyzer was employed with a mass range of m/z 50–500, with a resolution of about 1000 at m/z 300.

As mentioned above, the system 200 is capable of analyzing multiple samples simultaneously. The system 200 is housed in a single vacuum manifold and operated with a single set of control electronics. The system 200 includes a microfluidic system 204 which couples to a standard 96 well micro-titer plate such as the array of microfermentors 201, an array of CE columns or an array of membranes or an array of microspray tips, such as an array of electrospray ionizers 206, differential pumping and ion optics 208, the array of RIT analyzers 202, and an array of detectors 210. The cross-section of each of the components of the system 200 is chosen to match the dimensions of a standard 96-well micro titer plate. Thus, each well in the array 201 is associated with a sampler, an ionizer, a mass analyzer, and a detector. Note, however, that there is a non-linear placement of the detectors relative to the other components, which is a consequence of the geometry of the RIT analyzers 203.

When the system 200 is in use, samples from all wells (microtiter plate) in the array 201 is electrosprayed (nanosprayed) simultaneously in parallel by the array of electrospray ionizers 206. The nanospray nozzles for these ionizers are fabricated using microfabrication techniques. Stainless steel tips (50–150 nL/min) can be used. Microfluidic channels are integrated on-chip to the nanoelectrospray tips by fabricating the chips using polydimethylsiloxane (PDMS) casting techniques as well as parylene polmer. Polymer material generates no appreciable background signal, such that subattomole detection limits have been achieved.

The array 206 of ionizers can be implemented in different ways. For example, in one implementation, a multiplex ion source serves as an interface between the 96-well microtiter plate 201 and the array of RIT analyzers 202. This implementation employs an array of pneumatic nebulizers embedded into a polypropylene plate, which are nearly identical in size with the standard microtiter plate. The nebulizer array serves as a gastight cover for the microtiter plate, and the headspace of the plate is pressurized using nitrogen gas. The gas forces the liquid samples through the sprayer capillaries and enhances the spraying efficiency. The channels are also equipped with metal needles (one per nebulizer) mounted on a separate 96-hole plate to provide corona discharge ionization capability.

In another implementation, the array of ionizers 206 is based on microfabrication technology. This implementation includes an array of microfluidic chips. Each chip has a capillary electrophoresis device and an electrospray source on it. The chips are positioned into an array with their edge having the ESI capillary embedded facing the atmospheric interface of the instrument. Another type of chip carrying a membrane introduction system is designed and constructed for the purpose of volatile species detection. In the case of this latter application a fluid and a gas channel separated by a poly-dimethylsiloxane membrane is built on a chip. The chip also contains a heater element. This design implements the concept of membrane introduction mass spectrometry (MIMS) on a chip and provides high extraction efficiency for volatile species from a fluid having a biological origin. The extracted volatile species are ionized using corona discharge ionization as described above.

The system 200 includes a vacuum system with four stages to accommodate the gas load. The atmospheric interface is an array of 96 capillaries (each with an inner diameter of about 254 μm and a length of about 20 cm). The pressure in the first vacuum stage is about 2 Torr, maintained by a large two-stage rotary vane pump that provides a pumping speed of at least 195 $m^3$/hr. Upon passing through a tube lens and skimmer with an orifice with an inner diameter of about 500 μm, the ions in each channel enter the second vacuum stage, having a pressure of about $8\times10^{-3}$ Torr sustained by a turbo molecular drag pump with a minimum pumping speed of about 545 L/s at the inlet pressure. The ion population in each channel then passes through about a 1.5 mm diameter orifice to the third vacuum stage. The second and third vacuum stages both house square quadrupole arrays for ion transfer. The pressure in the third vacuum stage is about $3\times10^{-4}$ Torr, maintained by a turbo molecular drag pump with pumping speed of at least 505 L/s. Lastly, 96 apertures, each with an inner diameter of about 1.5 mm, separate the third and fourth vacuum stages. The final vacuum stage houses a square quadrupole array and the array of RIT mass analyzers 202 with associated detectors 210. The pressure in this vacuum stage is sustained at about $1\times10^{-5}$ Torr by a turbomolecular drag pump with a minimum pumping speed of about 575 L/s. Both electron multipliers and micro-channel plates are operational at this pressure without significant reduction of their lifetimes. Alternatively, if a Roots pump (500 $m^3$/hr or 1000 $m^3$/hr) is employed to handle the gas load in the first stage of vacuum, the pressure in this region can be reduced to 0.5 Torr or 1 Torr, respectively. Since square quadrupole arrays are used for the transfer of ions and are not expected to focus the individual ion populations to an area with of a diameter of less than ~1.0 mm, smaller apertures can be utilized for the interfaces between vacuum stages, which facilitates reducing the number of stages and/or the pumping speed required of the vacuum pumps.

Figure 12:
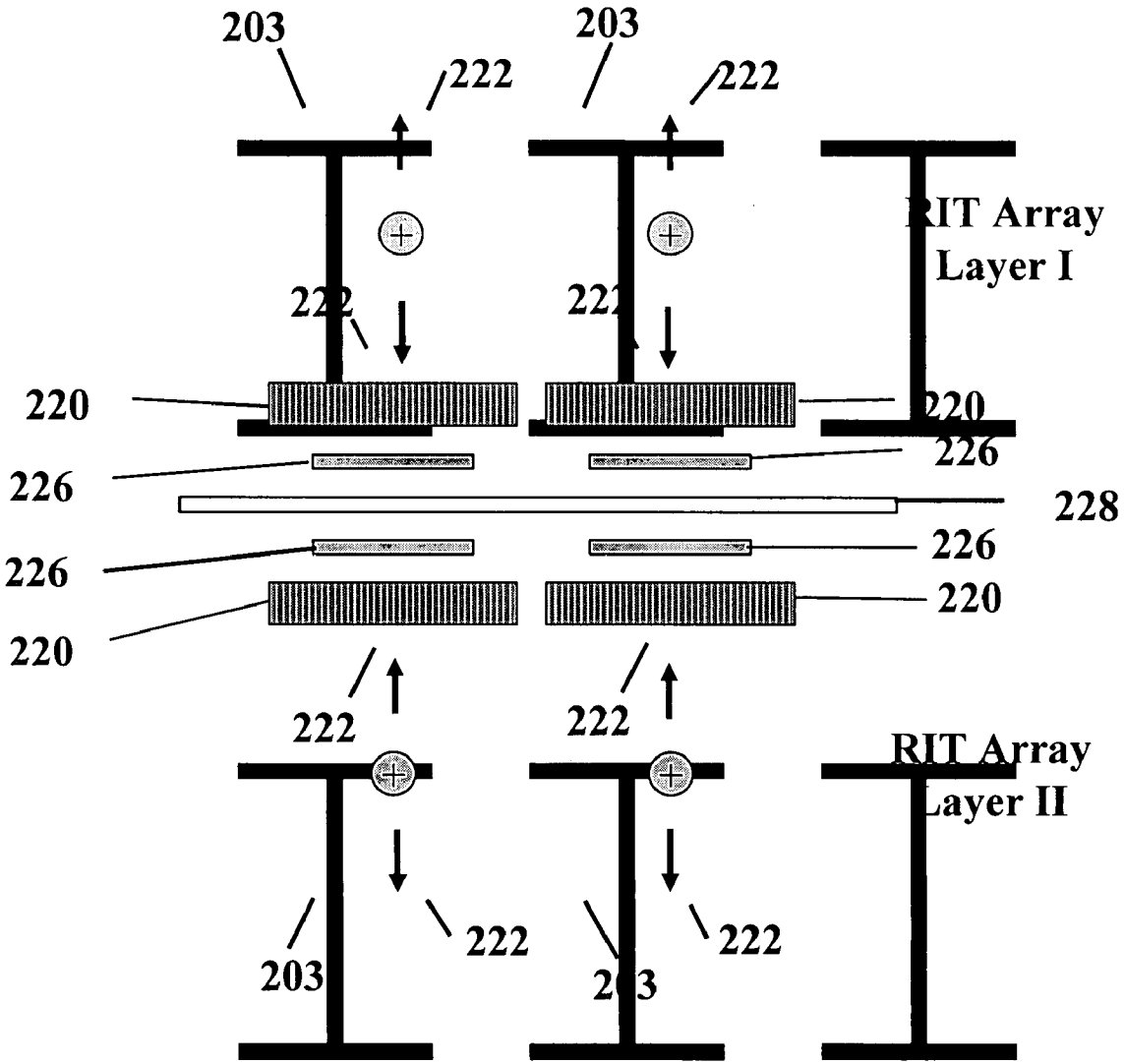
FIG. 12 shows a detection schematic for a portion of the array of RIT mass analyzers in accordance with the invention.
Figure 13:
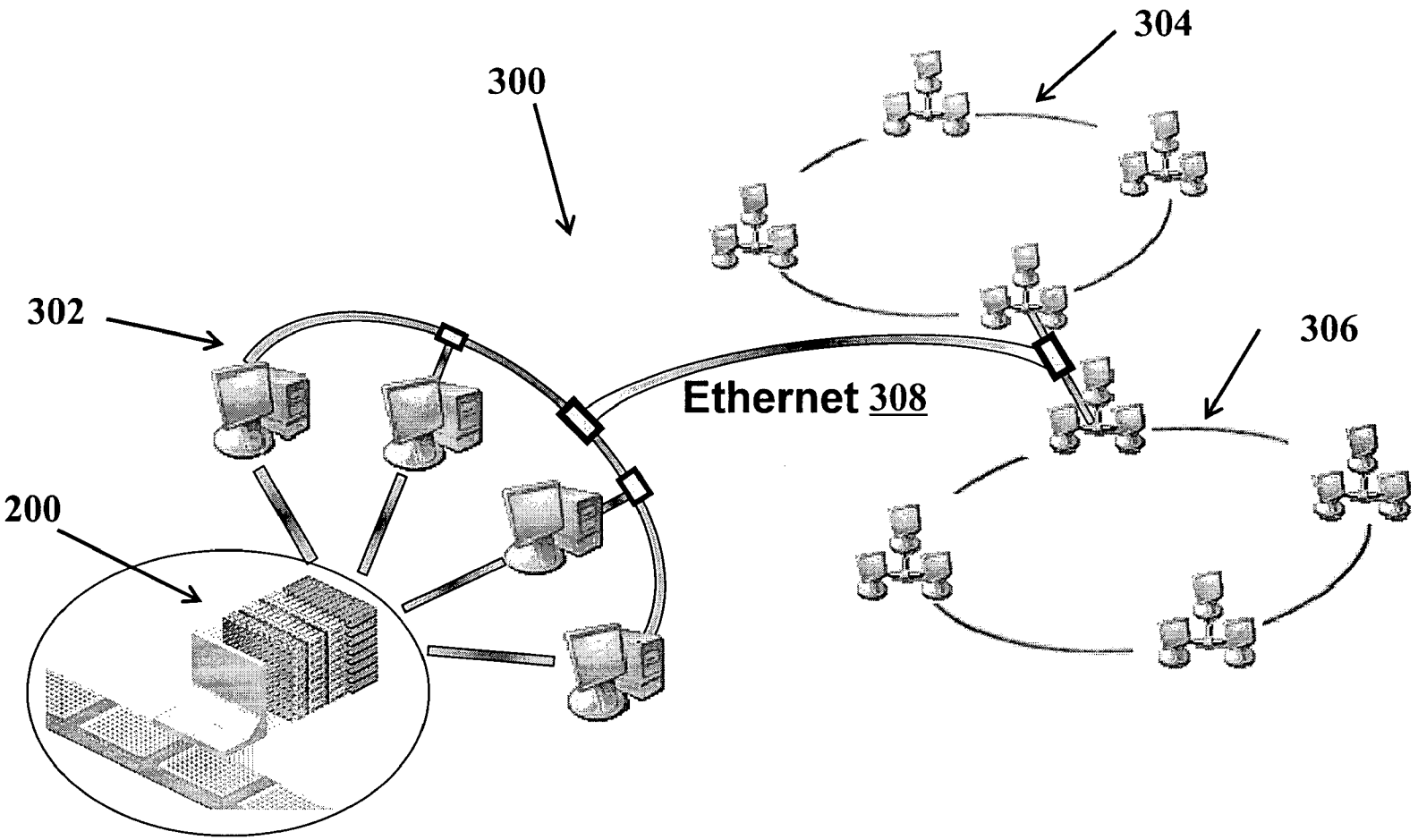
FIG. 13 is a schematic of a data acquisition system showing use of four local processor units and shared tasking for acquisition and processing in accordance with the invention.

Detection is accomplished using microchannel plates (MCP) 220 as shown in FIG. 12. The MCP 220 matches the ejection slit 222 for RIT analyzer 203. Dual detection is accomplished by placing a MCP 220 at both the radial ejection slits 222 of each RIT analyzer 208. The ions from the RIT slits 222 interact with the channels of the MCP 220 to produce charged pulses of electrons, emerging from the other side of the plate. The electron pulse is then accelerated to the anode 226, which generates a measurable current. Since in the system 200 the three-dimensional arrangement of the RIT arrays consists of 8 layers, each containing 12 traps, 96 individual MCP 220 and 96 anodes 226 are employed. To avoid signal overlap between adjacent RIT analyzers 203, a grounded shielding plate 228 is required between each layer of traps.

Data from the array 202 is acquired on a per trap basis such that each RIT analyzer 203 essentially operates as an individual mass spectrometer. A sampling rate of 50 kHz per channel is used to acquire a full mass spectrum, with each mass spectrum represented by approximately 5000 data points. Up to 24 channels of data may be acquired on a single multiple channel data acquisition card, such that four cards are used. The data acquisition system includes two individual data acquisition computers operating in parallel, each collecting data from half of the array 202. By distributing the data acquisition duty between two computers, some of the computing resources are available for preprocessing of the data before the data is transferred to the next stage for further analysis.

In a particular implementation, metabolomics determines the physiological status of a sample or tissue by comparing the concentration of small molecules in a tissue or sample with a similar measurement in a control sample. The system 200 is used to display relative differences in concentrations of small molecules in control and experimental samples (labeled with heavy isotopes). Because data processing is repetitive and time consuming (since each spectrum contains about 50,000 data points), data reduction is needed to replace raw spectra by one representative spectrum with better signal-to-noise ratio and accuracy before date are transferred to the central computer. Thus, initially, the spectra is converted to a peak list (masses and abundances of the target metabolites for the spectra for each sample channel. Next, analyses is performed on the spectra to confirm known metabolites to identify unknowns by statistic algorithms. Subsequently, there is many 'junk' spectra, which is discarded at this stage rather than submitting them to a central computer cluster. All these data reduction process is automated, such that it is less likely that data transcription and calculation errors occur. In a particular analysis system 300, the system 200 is used in combination with four local processor units 302 which communicate with remote computer clusters 304, 306 through, for example, an Ethernet connection 308 for shared tasking of acquisition and processing.

Other embodiments are within the scope of the following claims.

What is claimed is:

1. A multiplexed mass spectrometer for characterizing the molecular structure of samples, the system comprising:

an array of mass analyzers, each mass analyzer being associated with one or more data channels; and a data acquisition system that selectively reduces the number of data channels through combinations of particular channels to define data acquisition modes for the molecular characterization of the samples.

2. The spectrometer of claim 1 wherein the selective reduction in channels is achieved by software manipulation of the acquired data.

3. The spectrometer of claim 1 wherein the selective reduction in channels is achieved by combining detected signals from the mass analyzers.

4. The spectrometer of claim 1 wherein the selective reduction in channels is achieved by grouping ions by type before mass analysis.

5. The spectrometer of claim 1 wherein the data acquisition system compares data between grouped channels.

6. The spectrometer of claim 1 wherein fast screening is used to identify targeted compounds in a group of samples.

7. The spectrometer of claim 1 wherein the acquisition modes are used to monitor the intensities of the targeted compounds for a group of samples.

8. The spectrometer of claim 1 wherein the mass analyzers are rectilinear ion traps.

9. The spectrometer of claim 8 wherein two-direction radial ejection is used to implement two data acquisition modes simultaneously.

10. The spectrometer of claim 8 wherein axial ejection is used to implement additional data acquisition modes.

11. The spectrometer of claim 8 wherein x, y radial ejection and axial ejection are used to implement multiple data acquisition modes.

12. The spectrometer of claim 8 wherein the array is used to allow ion transfer to achieve ion recombination modes.

13. The spectrometer of claim 1 wherein the mass analyzers are selected from the group consisting of ion traps, rectilinear ion traps, quadrupole ion traps, and cylindrical ion traps.

14. The spectrometer of claim 13 wherein ions are redistributed by mass-selectivity or non-mass-selectivity transferring between the mass analyzers.

15. The spectrometer of claim 1 further comprising an array of ionizers which ionize multiple samples.

16. The spectrometer of claim 15 wherein the array of mass analyzers is an array of multiple types of mass analyzers and the array off ionizers is an array of multiple type of ionizers.

17. A multiplexed mass spectrometer system comprising:

a microfluidic handling system which collects samples from an array of samples;

an array of ionizers which ionize multiple samples collected by the microfluic handling system;

an array of ion traps, each ion trap being associated with one or more data channels, each data channel being associated with particular groups of the samples; and a data acquisition system that selectively reduces the number of data channels through combinations of particular channels to define data acquisition modes.

18. A method for characterizing the molecular structure of samples comprising:

directing ions associated with the samples with an array of mass analyzers, each mass analyzer being associated with one or more data channels; and selectively reducing the number of data channels through combinations of particular channels to define data acquisition modes for molecular characterization of the samples.

19. The method of claim 18 wherein the selective reduction in channels is achieved by software manipulation of the acquired data.

20. The method of claim 18 wherein the selective reduction in channels is achieved by combining detected signals from the mass analyzers.

21. The method of claim 18 wherein the selective reduction in channels is achieved by grouping ions by type before mass analysis.

22. The method of claim 18 further comprising comparing data between grouped channels.

23. The method of claim 18 further comprising fast screening to identify targeted compounds in a group of samples.

24. The method of claim 18 wherein the mass analyzers are rectilinear ion traps.

* * * * *

UNITED STATES PATENT AND TRADEMARK OFFICE

CERTIFICATE OF CORRECTION

PATENT NO. : 7,157,699 B2
APPLICATION NO. : 11/092106
DATED : January 2, 2007
INVENTOR(S) : Zheng Ouyang et al.

It is certified that error appears in the above-identified patent and that said Letters Patent is hereby corrected as shown below:

On the Title Page: Item [56]

Column 1, line 6, under "U.S. PATENT DOCUMENTS", after "6,580,070" delete "B1" and substitute --B2-- in its place.

Column 1, line 7, under "U.S. PATENT DOCUMENTS", after "6,664,079" delete "B1" and substitute --B2-- in its place.

Column 1, line 8, under "U.S. PATENT DOCUMENTS", after "6,762,406" delete "B1" and substitute --B2-- in its place.

Column 1, line 10, under "U.S. PATENT DOCUMENTS", after "6,838,666" delete "B1" and substitute --B2-- in its place.

Column 2, line 8, under "OTHER PUBLICATIONS", delete "*Kiebsiella*" and substitute --*Klebsiella*-- in its place.

Page 2, column 2, line 13, delete "Oct. 25, 2000" and substitute --Oct. 15, 2000-- in its place.

In the Claims

Column 9, in claim 16, line 3, after "and the array" delete "off" and substitute --of-- in its place.

Signed and Sealed this

Eighth Day of May, 2007

JON W. DUDAS
*Director of the United States Patent and Trademark Office*